US008879760B2

(12) United States Patent
Bleacher et al.

(10) Patent No.: US 8,879,760 B2
(45) Date of Patent: Nov. 4, 2014

(54) DIRECTIONAL SOUND SYSTEMS AND RELATED METHODS

(75) Inventors: Brett Bleacher, Rancho Santa Margarita, CA (US); Christopher K. Mondragon, Laguna Niguel, CA (US)

(73) Assignee: Thales Avionics, Inc., Irvine, CA (US)

( * ) Notice: Subject to any disclaimer, the term of this patent is extended or adjusted under 35 U.S.C. 154(b) by 0 days.

(21) Appl. No.: 13/605,485

(22) Filed: Sep. 6, 2012

(65) Prior Publication Data

US 2014/0064524 A1 Mar. 6, 2014

(51) Int. Cl.
*H04R 3/00* (2006.01)

(52) U.S. Cl.
USPC ..... 381/303; 381/77; 381/182

(58) Field of Classification Search
USPC ..... 381/303, 304–307, 77, 79, 111, 117, 381/150, 73.1; 367/137, 138; 455/569.1, 455/569.2
See application file for complete search history.

(56) References Cited

U.S. PATENT DOCUMENTS

2004/0209654 A1* 10/2004 Cheung et al. ..... 455/567
2010/0150361 A1 6/2010 Kim
2010/0284544 A1 11/2010 Kim

FOREIGN PATENT DOCUMENTS

DE 199 38 171 A1 3/2001

OTHER PUBLICATIONS

Betlehem et al., "A constrained optimization approach for multi-zone surround sound," 2011 IEEE International Conference on Acoustics, Speech and Signal Processing, May 22, 2011, pp. 437-440.
Shin et al., "Maximization of acoustic energy difference between two spaces," The Journal of the Acoustical Society of America, American Instititue of Physics for the Acoustical Society of America, vol. 128, No. 1, Jul. 1, 2010.
Notification of Transmittal of the International Search Report and the Written Opinion of the International Searching Authority, or the Declaration, PCT/US2013/055932, Nov. 14, 2013, 10 pages.

* cited by examiner

*Primary Examiner* — Tuan D Nguyen
(74) *Attorney, Agent, or Firm* — Myers Bigel Sibley & Sajovec

(57) ABSTRACT

Entertainment systems are provided including directional sound speakers associated with a media player of the entertainment system; and a directional sound controller associated with the directional sound speakers of the media player. The directional sound controller is configured to direct a sound beam associated with the media player at a defined target region such that the sound beam is only audible within the defined target region and experiences less than about 20 dB of leakage outside the target region during operation of the media player. In-flight entertainment systems and related methods are also provided.

34 Claims, 7 Drawing Sheets

DIRECTIONAL SOUND SYSTEMS AND RELATED METHODS

TECHNICAL FIELD

Embodiments described herein relate generally to electronic entertainment systems and, more particularly, to sound systems for use in entertainment systems.

BACKGROUND

The approaches described in this section could be pursued, but are not necessarily approaches that have been previously conceived or pursued. Therefore, unless otherwise indicated herein, these approaches are not known to be prior art and are not admitted to be prior art by inclusion in this section.

Directional sound is a technology that concentrates acoustic energy into a narrow beam so that it can be projected to a discrete area, similar to how a spotlight focuses light on a particular area of interest. When sound waves are focused in this manner, these sound waves behave in a manner somewhat resembling the coherence of light waves in a laser. When a sound beam is aimed at a listener, that person senses the sound as if it is coming from, for example, a headset or earphones. When the listener steps outside of the sound beam or when the sound beam is redirected, the sound disappears.

Directional sound has many advantages over conventional headsets or earphones, which are typically required to listen to audio. Headphones and/or earphones can be uncomfortable when used over a long period of time. When headphones/earphones are intended for use in a public setting, hygiene problems can arise in that these accessories may become unsanitary or unattractive to listeners. Moreover, headphones/earphones are subject to wear, which can diminish their useful life and increase maintenance costs. Furthermore, there is the potential for abuse and damage from vandalism to these accessories.

SUMMARY

Some embodiments of the present inventive concept provide entertainment systems including directional sound speakers associated with a media player of the entertainment system; and a directional sound controller associated with the directional sound speakers of the media player. The directional sound controller is configured to direct a sound beam associated with the media player at a defined target region such that the sound beam is only audible within the defined target region and experiences less than about 20 dB of leakage outside the target region during operation of the media player.

In further embodiments, the target region may experience no greater than about 5.0 dB of leakage during operation of the media player.

In still further embodiments of the present inventive concept, the directional sound controller may include a beam forming and audio wave shaping module configured to direct the sound beam such that the sound beam extends to a preset distance from the directional sound speakers.

In some embodiments, the preset distance may be from about 2.5 to about 10 feet from the directional sound speakers. In certain embodiments, the sound beam may extend no greater than about 2.5 feet from the directional sound speakers.

In further embodiments, the entertainment system may further include transducers and/or a sound dome. The beam forming and audio wave shaping module may be configured to direct the sound beam such that the sound beam extends to a preset distance from the directional sound speakers, the transducer and/or the sound dome.

In still further embodiments, the beam forming and audio wave shaping module may be further configured to direct the sound beam in a horizontal direction away from the directional sound speakers and toward the target region.

In some embodiments, the system may further include a seat within the target region, wherein the media player and directional sound speakers are integrated in a back portion of the seat. A hood configured to be positioned over the target region may also be provided to create a cone of sound for the target region. In certain embodiments, a hood may be a plexiglass hood. Each of the directional sound speakers may include a cluster of smaller speakers and/or transducers.

In further embodiments, the system may further include a media player and directional sound speakers integrated in a back portion of the seat, wherein the seat comprises sound absorbing materials.

In still further embodiments, the directional sound controller may further include a noise cancelling/reduction module that is configured to reduce and/or neutralize sound leakage outside the target region.

In some embodiments, each of the directional sound speakers may be configured to include a plurality of audio transducers. The plurality of audio transducers may be from about 50 to about 200 audio transducers.

In further embodiments, the entertainment system may be an in-flight entertainment (IFE) system on an aircraft. The IFE system may be designed to comply with all relevant government and airlines standards.

In still further embodiments, the media player may be a smart video display unit associated with the IFE system, the smart video display unit being integrated into a seatback on the aircraft. The target region may be one of a seat on the aircraft, a group of seats on the aircraft and a specific location in a common area on the aircraft. The target region may be a seat in one of first class, business class and coach class. The target region may be a single user or group of users.

In some further embodiments, the entertainment system may be integrated with a vehicle. The vehicle may be one of a train, a bus, a cruise ship and a military aircraft.

Further embodiments provide IFE systems for use on an aircraft, the IFE system including a media player integrated into the aircraft; directional sound speakers associated with the media player of the IFE system; and a directional sound controller associated with the directional sound speakers of the media player. The directional sound controller is configured to direct a sound beam associated with the media player at a defined target region of the aircraft such that the sound beam is only audible within the defined target region of the aircraft and experiences less than about 20 dB of leakage outside the target region during operation of the media player.

In still further embodiments, the media player may be integrated into a seat back of the aircraft; the target region may include a passenger seated in a seat of the aircraft; and the directional sound controller is configured to direct a sound beam associated with the media player at the passenger seated in the seat of the aircraft such that the sound beam is only audible by the passenger seated in the seat.

Some embodiments provide methods of directing sound of a media player on an aircraft, the method including directing a sound beam associated with a media player integrated in an in-flight entertainment (IFE) system of the aircraft at a defined target region of the aircraft such that a sound beam created by directional sound speakers associated with the media player of the IFE system is only audible within the defined target region of the aircraft and experiences less than about 20 dB of leakage outside the target region during operation of the media player.

BRIEF DESCRIPTION OF THE DRAWINGS

The accompanying drawings, which are included to provide a further understanding of the disclosure and are incorporated in and constitute a part of this application, illustrate certain non-limiting embodiments of the inventive concept. In the drawings.

DETAILED DESCRIPTION

Figure 1:
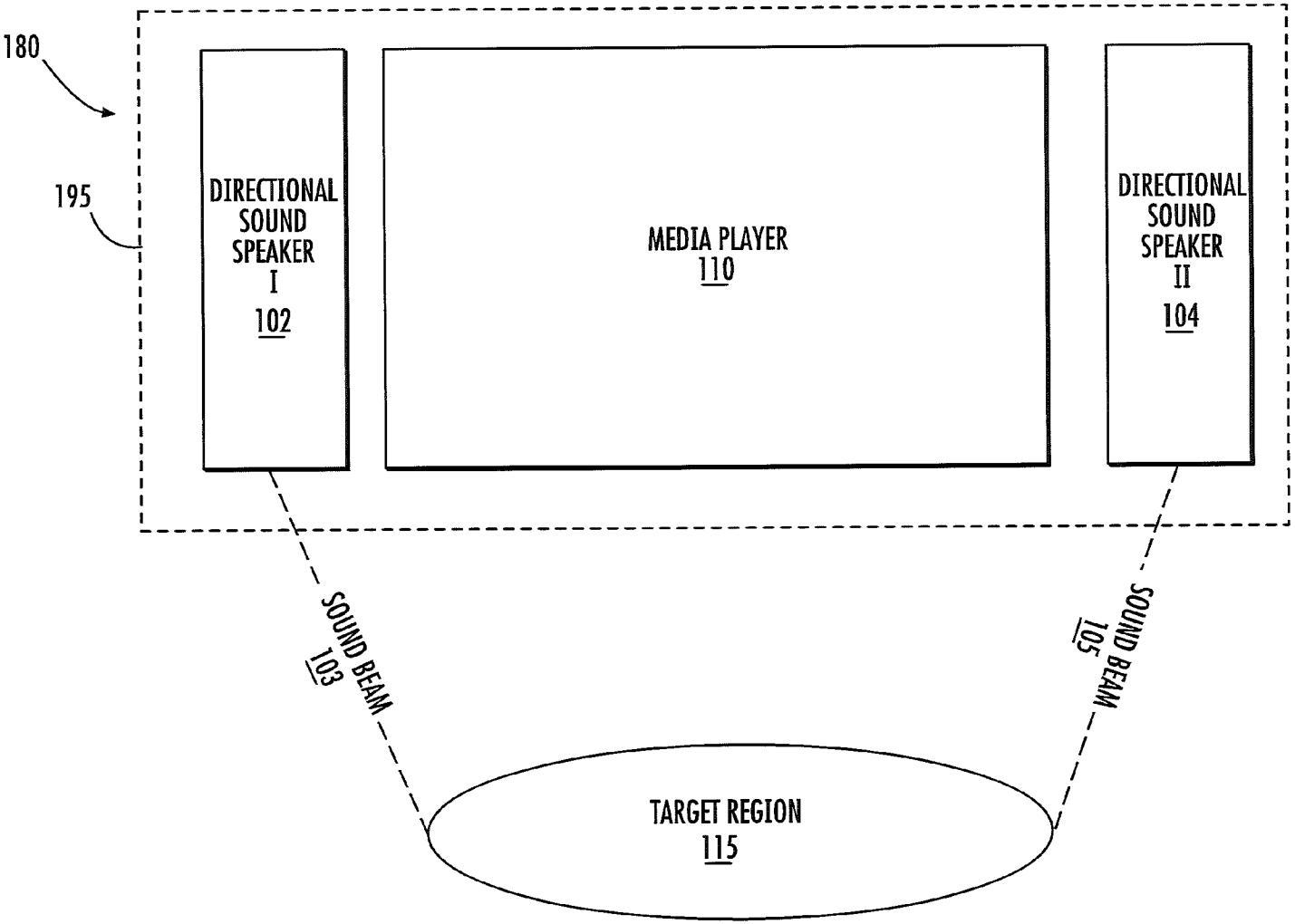
FIG. 1 illustrates a directional sound system including a media device and directional sound speakers in accordance with some embodiments of the present inventive concept.

The following detailed description discloses various non-limiting example embodiments of the inventive concept. The inventive concept can be embodied in many different forms and is not to be construed as limited to the embodiments set forth herein.

Although various embodiments of the present inventive concept will be discussed herein with respect in-flight entertainment (IFE) systems integrated in a seat of an aircraft, embodiments of the present inventive concept are not limited to this configuration. For example, embodiments of the present inventive concept may be used in any environment that would benefit from the details thereof. For example, embodiments of the present inventive concept may be used in entertainment systems on trains, buses, or cruise ships as well as in military aircrafts for training, briefing and debriefing without departing from the scope of the present inventive concept.

As discussed above, headsets or earphones are typically used to listen to audio, for example, audio provided by an IFE on the aircraft. Use of accessories, such as headphones and earphones, can have disadvantages, for example, these accessories may be uncomfortable when used over a long period of time. Furthermore, when used in a public environment, these accessories may have to be cleaned and maintained by the airlines and handed out and collected by the flight attendants, which can be time consuming. Furthermore, audio jacks connected to the headphones/earphones can break easily due to over use or abuse, which causes an added expense of replacing the headphones/earphones. Some airlines provide headphones/earphones free of charge or for minimal cost, however, the quality of these headphones/earphones is typically very poor.

Accordingly, some embodiments of the present inventive concept provide directional sound systems that enable listeners to hear audio presented on a media device without the use of headphones/earphones or similar accessory. As will be discussed herein with respect to FIGS. 1 through 9, in some embodiments, directional sound technology can be embedded within an aircraft seat configuration whereby the passenger can hear good quality audio sound from the media device without the use of accessories. Embodiments of the present inventive concept may be used in combination with premium, first class, business class and/or coach class seating without departing from the scope of the present inventive concept. In further embodiments, directional sound technology may also be implemented in social or bar areas of the aircraft without departing from the scope of the present inventive concept.

Some conventional headsets/earphones or the IFE system itself are connected to include noise cancellation/reduction circuitry to mask aircraft and passenger noise. These noise cancellation/reduction circuits can be built into the IFE hardware or the headphone jack located in, for example, the seatback or seat arm. Directional sounds systems in accordance with embodiments discussed herein may eliminate the need to use utilize headphones or earphones as will be discussed herein.

Referring first to FIG. 1, a directional sound system 180 in accordance with some embodiments of the present inventive concept will now be discussed. As illustrated in FIG. 1, the directional sound system 180 includes a media player 110 and associated first and second directional sound speakers 102 and 104. It will be understood that although directional sound speakers 102 and 104 are illustrated as single speakers, these speakers may be made up of clusters of smaller speakers and/or transducers without departing from the scope of the present inventive concept. Similarly, although only two directional sound speakers 102 and 104 are illustrated in FIG. 1, one or more than two directional sound speakers may be present in the system 180 without departing from the scope of the present inventive concept. Finally, although the media player 110 and the directional sound speakers 102/104 are illustrated as separate components, these components can be combined into one integrated device as illustrated by the dotted line 195.

Figure 2A:
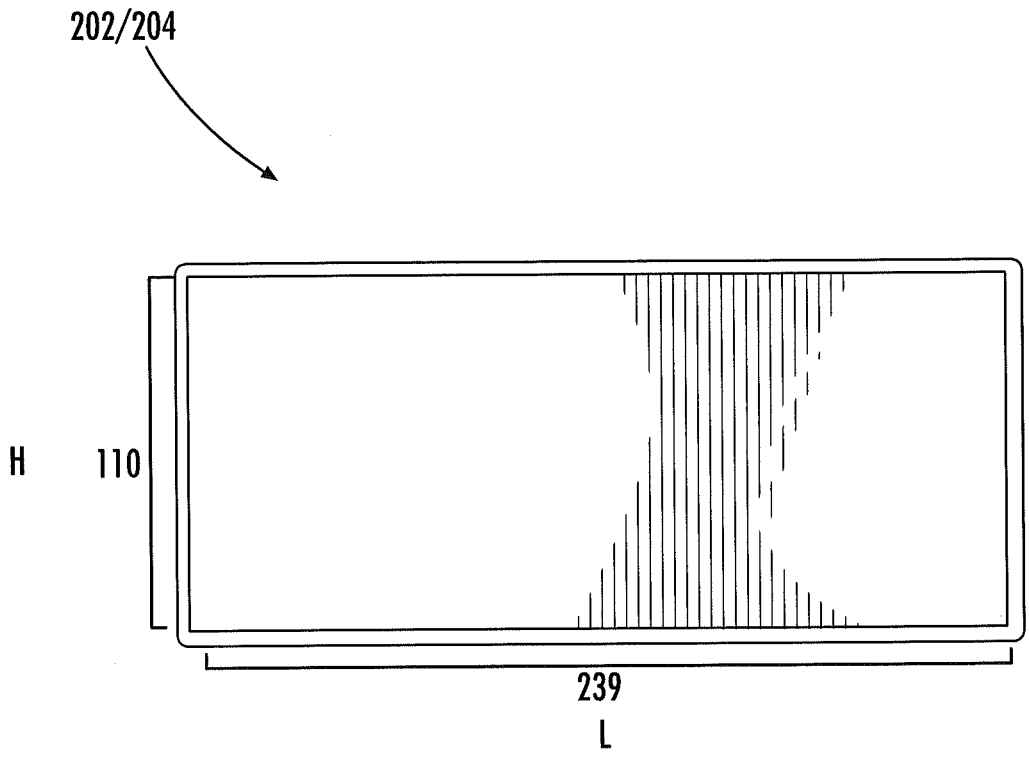
FIGS. 2A and 2B are diagrams illustrating example directional sound speakers in accordance with some embodiments of the present inventive concept.
Figure 2B:
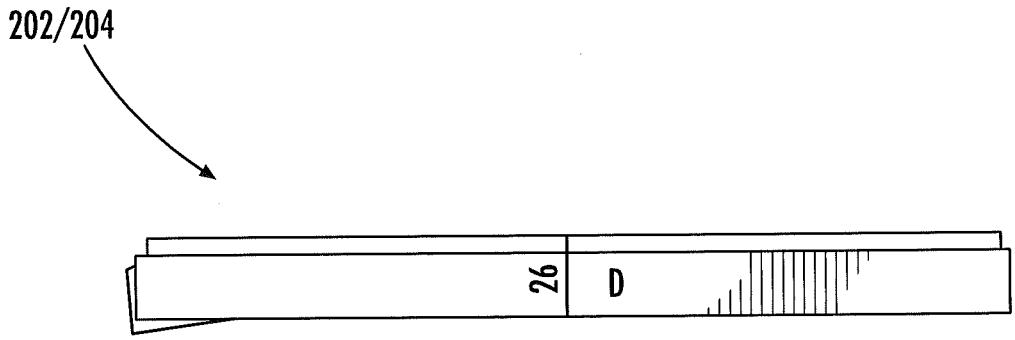
Figure 3B:
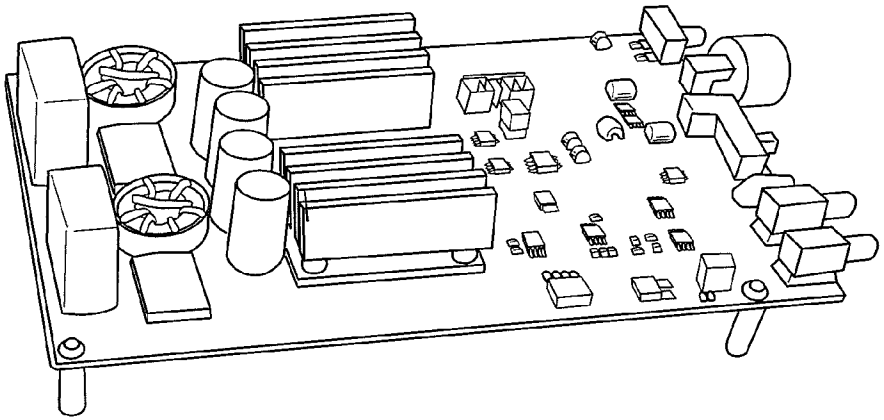
FIGS. 3A and 3B are diagrams of components that may be included in the directional sound speakers of FIGS. 1-2B in accordance with some embodiments of the present inventive concept.
Figure 3A:
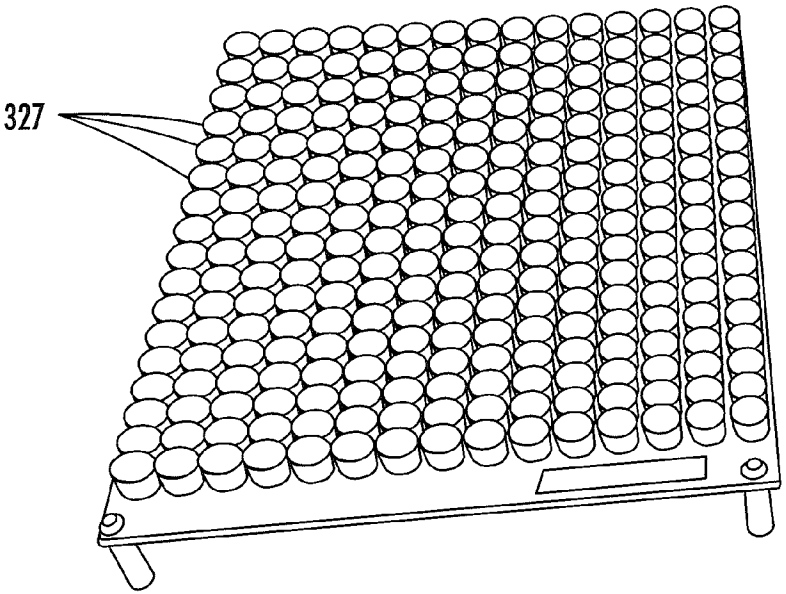

Example embodiments of directional sound speakers 102 and 104 are illustrated in FIGS. 2A through 3B. FIGS. 2A and 2B are diagrams illustrating a front view and side view of a directional sound speaker 202/204, respectively, in accordance with some embodiments of the present inventive concept. The directional sound speakers 202/204 illustrated in FIGS. 2A and 2B have a length L of about 9.45 inches (24 cm), a height H of about 4.33 inches (11 cm) and a depth D of about 1.06 inches (2.7 cm). The directional sound speaker 202/204 illustrated in FIGS. 2A and 2B may include a plurality of audio transducers 327, for example, 50 to 200 audio transducers as illustrated in FIG. 3A. Each of these speakers 202/204 may include both a right and left channel to produce stereo audio. FIG. 3B illustrates a speaker controller board in accordance with some embodiments. The directional sound controller will be discussed further below.

Referring again to FIG. 1, the directional sound system is configured to direct a sound beam 103/105 associated with the media player 110 at a defined target region 115, such that the sound beam 103/105 is only audible within the defined target region 115. As used herein, a "sound beam" refers to the output of the directional sound system 180 according to some embodiments of the present inventive concept. Thus, the sound beam 103/105 is the product of the sound waves being focused into a beam 103/105 directed at the target region. The target region could be, for example, a person or group of persons. In particular embodiments, the target region could be a person in a seat of an aircraft as will be discussed further below. Directional sound systems 180 in accordance with embodiments of the present inventive concept experience less than about 20 dB of leakage outside the target region 115 during operation of the media player. In particular, embodiments the target region 115 experiences no greater than about 5.0 dB of leakage during operation of the media player.

In an aircraft environment, while in flight, the aircraft exhibits approximately 80 dB of noise. Thus, the 20 dB or less of noise leakage experienced by embodiments of the present inventive concept would typically not be audible to the passengers outside the target region 115 during the flight. However, the aircraft noise significantly decreases when the aircraft is on the ground; thus, the least amount of leakage outside the target region is desirable.

Figure 4:
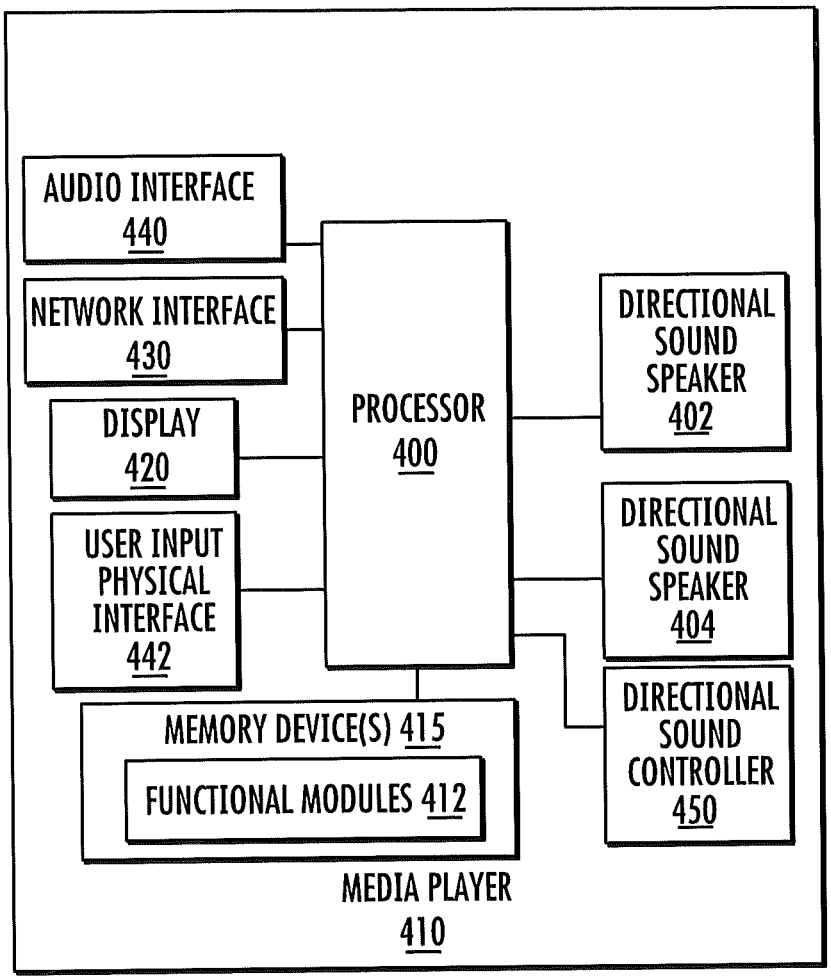
FIG. 4 is a block diagram illustrating components of a media player in accordance with some embodiments of the present inventive concept.

Referring again to FIG. 1, the media player 110 may be, for example, a smart video display unit (SVDU) of an IFE system. Details of the media player 110 will now be discussed with respect to the block diagram of FIG. 4 illustrating example components that may be included in a media player, such as the SVDU according to some embodiments. Referring to FIG. 4, the media player 410 includes a processor 400, memory device(s) 415 that contain functional modules 412, the directional sound speakers 402 and 404, a display device 420 (e.g., a liquid crystal display which may include a touch-sensitive interface), an audio interface 440, and/or a wired or wireless network interface 430. The media device 410 may further include a physical interface 442 (e.g., switches, control wheels, buttons, keypad, keyboard, etc.) that can be manipulated by a passenger to control the media device 410 and other defined components/systems within the aircraft.

The processor 400 includes one or more data processing circuits, such as a general purpose and/or special purpose processor (e.g., microprocessor and/or digital signal processor). The processor 400 is configured to execute computer program instructions from the functional modules 412 in the memory device(s) 410, described below as a computer readable medium, to perform some or all of the operations and methods that are described herein for one or more of the embodiments.

The processor 400 may receive music, video, games, data, and application programs through the network interface 430, which it processes for display on the display device 420 and/or for output as audio through the audio interface 440 to, for example, directional sound speakers 402/404 using the directional sound controller 450 in accordance with embodiments of the present inventive concept.

It will be understood that although the directional sound speakers 402 and 404 are depicted in FIG. 4 as being part of the media player 410, these components may be separate without departing from the scope of the present inventive concept.

Figure 5:
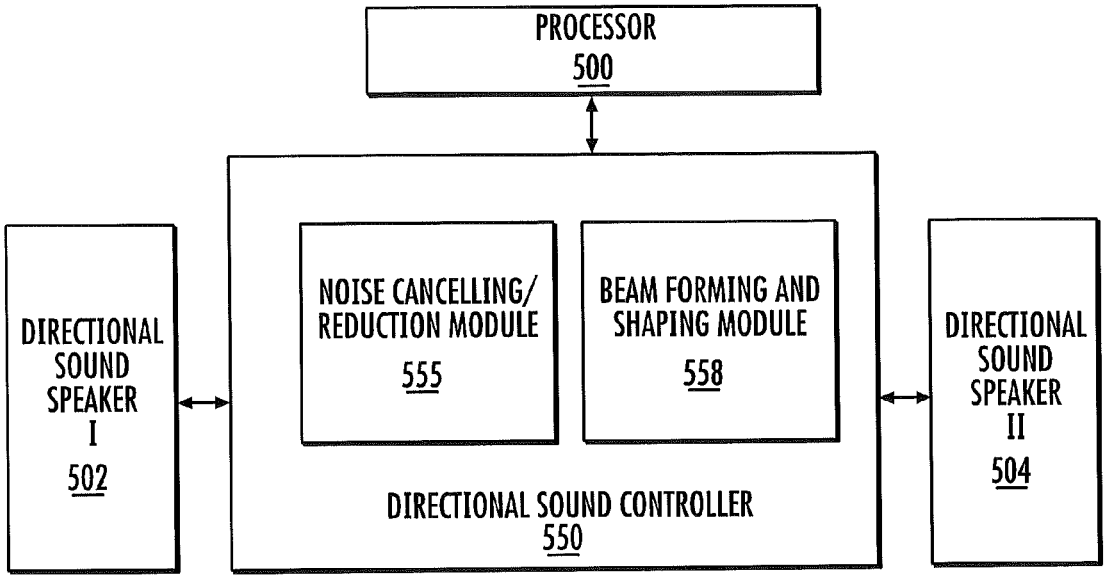
FIG. 5 is a block diagram of a directional sound system in accordance with some embodiments of the present inventive concept.

Referring now to FIG. 5, details of the directional sound controller 450 in accordance with some embodiments of the present inventive concept will be discussed. As illustrated in FIG. 5, the directional sound controller 550 is coupled to the directional sound speakers 502 and 504 and the processor 500 discussed above with respect to FIG. 4. The directional sound controller 550 includes a beam forming and audio wave shaping module 458 and a noise cancelling/reduction module 455.

The directional sound controller 550 is configured to direct a sound beam associated with the media player at a defined target region such that the sound beam is only audible within the defined target region and experiences less than about 20 dB of leakage outside the target region during operation of the media player.

In particular embodiments, the beam forming and audio wave shaping module 558 may be configured to direct the sound beam in a horizontal direction away from the directional sound speakers 502/504 and toward the target region. The noise cancelling/reduction module 555 is configured to reduce sound leakage outside the target region. As discussed above, in some embodiments the leakage outside the target region may be no greater than about 5.0 dB.

It will also be understood that in some embodiments, the noise cancelling/reduction module 555 may be configured to produce substantial or possibly total silence within the target region without departing from the scope of the present inventive concept.

As discussed above, some embodiments of the directional sound system discussed herein can be used in combination with an IFE system of an aircraft. However, embodiments of the present inventive concept are not limited to this configuration. For example, embodiments of the present inventive concept may be used in other vehicles, such as a car, a train, a bus, a cruise ship and a military aircraft without departing from the scope of the present inventive concept.

Figure 6:
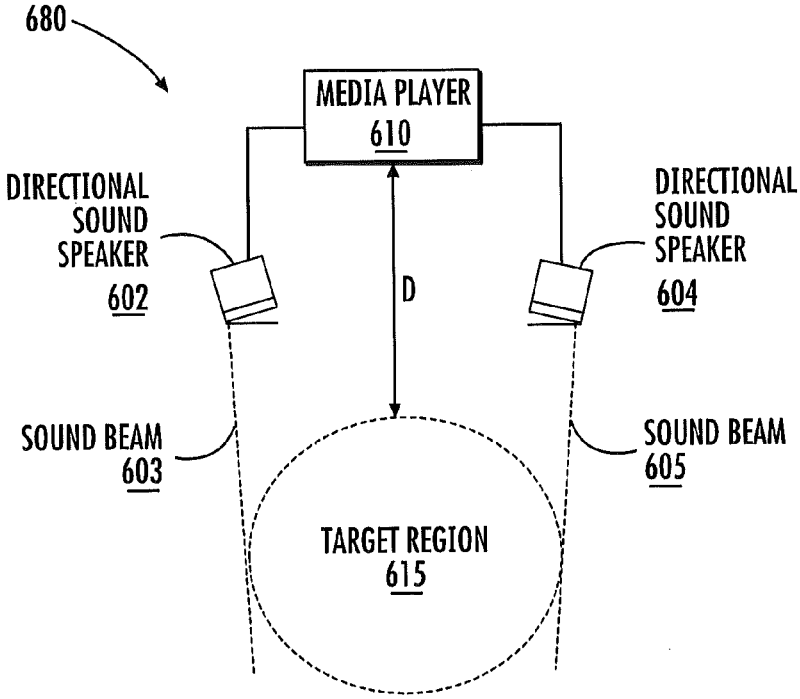
FIG. 6 is a block diagram of a directional sound system defining a target region according to some embodiments of the present inventive concept.

Referring now to FIGS. 6 through 9, embodiments of the present inventive concept integrated in an IFE system of an aircraft will be discussed. The aircraft environment presents a unique issue for directional sound applications due to the close proximity of passengers. Referring to FIG. 6, a block diagram of a directional sound system 680 in accordance with some embodiments will be discussed. As illustrated therein, the distance between the media player and the target region 615, or in this case, the passenger seated in the seat of the aircraft, is very small. For example, for a business class seat the distance D may be from about 4.0 to about 6.0 feet. In a coach class seat, this distance D may only be about 2.5 feet. Thus, in a coach class seat, a reduction in size of the directional sound speakers and a modified controller to shorten the range (less than 2.5 feet) may be needed. Thus, the beam forming and audio wave shaping module 558 may be configured to direct the sound beams 603 and 605 such that the sound beam only extends from about 2.5 to about 6.0 feet from the directional sound speakers 602/604 or media player 610 to the target region 615.

It will be understood that the beam forming an audio shaping module 558 is configured to direct the sound beam such that the sound beam extends to a preset distance. In some embodiments, this preset distance is from about 2.5 to about 10 feet, however, embodiments of the present inventive concept is not limited to these distances.

Figure 7:
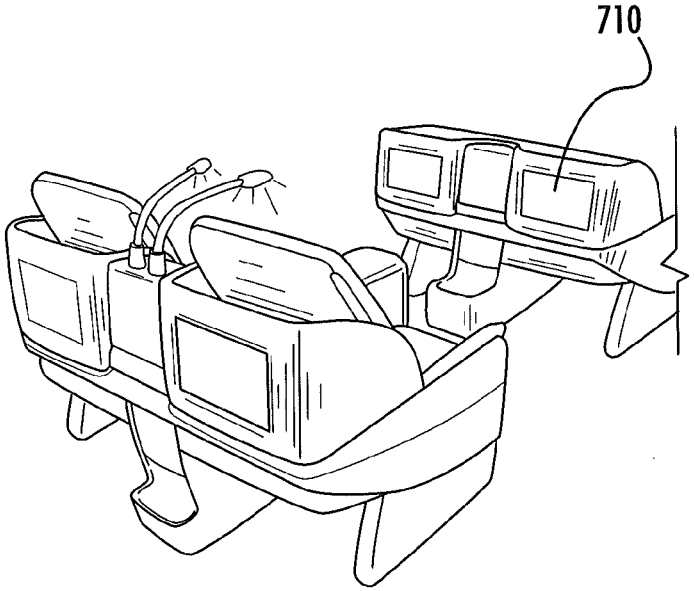
FIG. 7 is a block diagram illustrating a seat configuration including a directional sound system in accordance with some embodiments of the present inventive concept.
Figure 8:
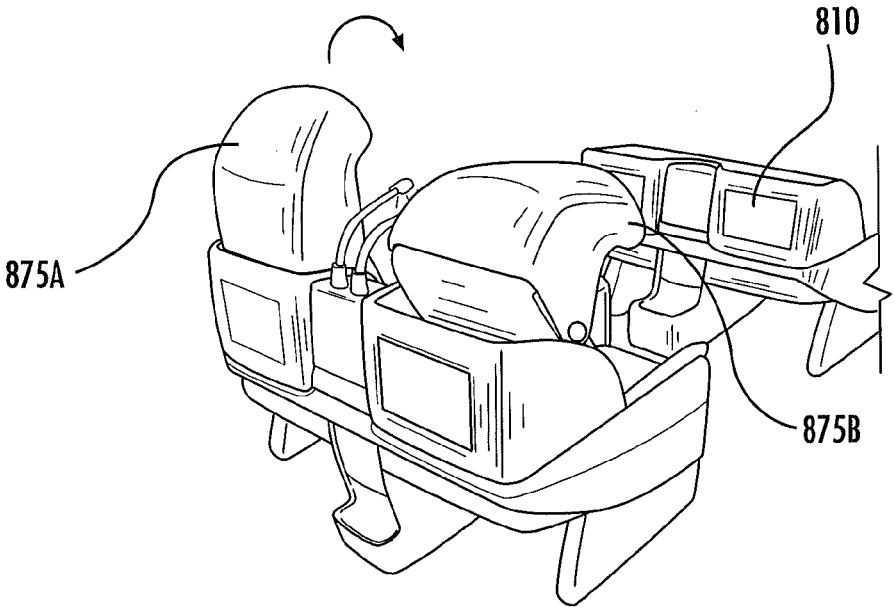
FIG. 8 is a block diagram illustrating an alternative seat including a directional sound system in accordance with some embodiments of the present inventive concept.

As illustrated in FIGS. 7 and 8, in some embodiments the media player and the directional sound speakers are integrated in a seatback of a seat on an aircraft 710/810. In some embodiments, the seats may be made of sound absorbing materials. As illustrated in FIG. 8, in some embodiments, the system includes a hood 875 (sound dome) that can be moved from a first position 875A to a second position 875B to create a cone of sound for the passenger seated in the seat. In some embodiments, this hood may be made of Plexiglas.

Figure 9:
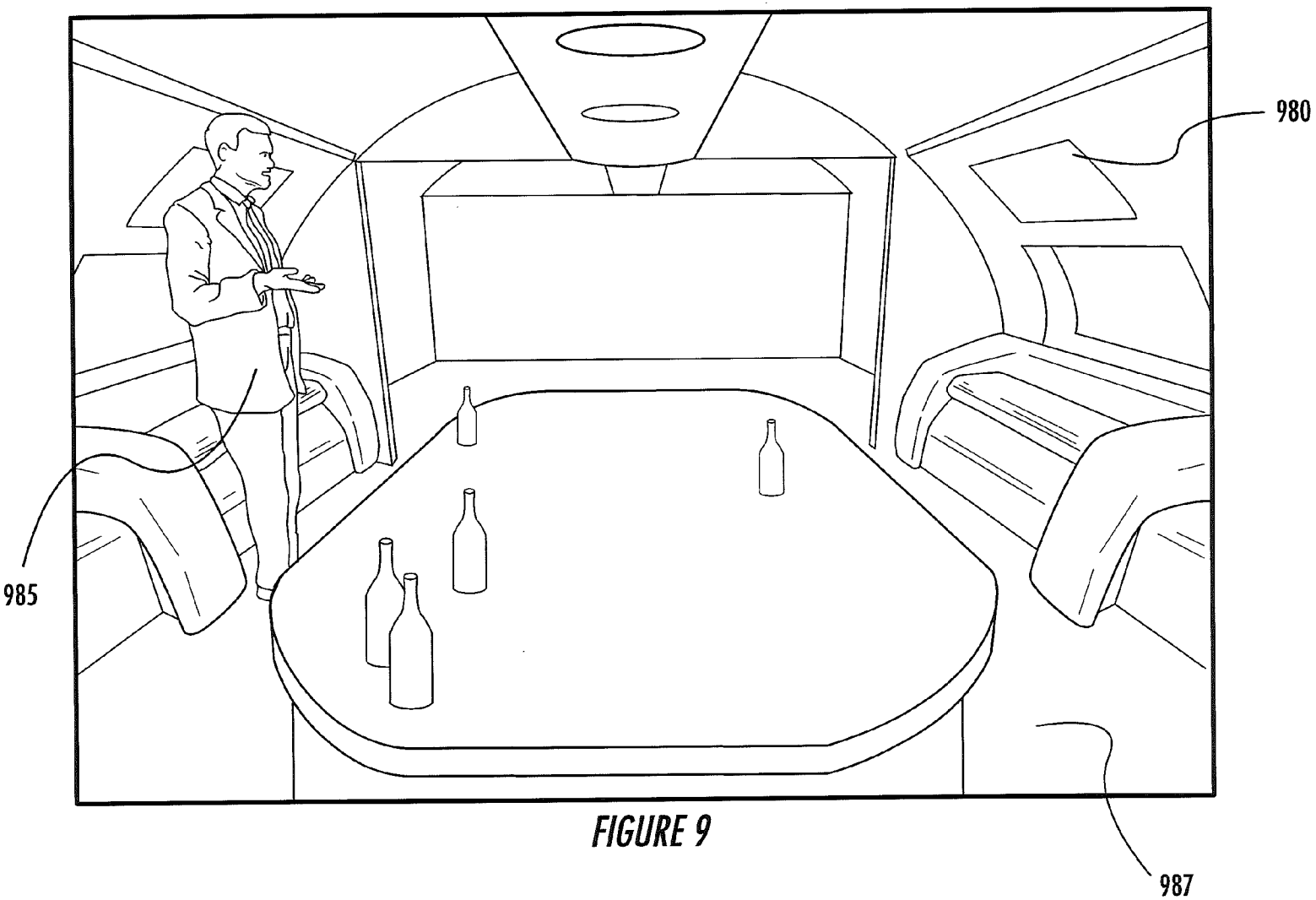
FIG. 9 is a block diagram illustrating a common area including a directional sound system in accordance with some embodiments of the present inventive concept.

Referring now to FIG. 9, the directional sound system in accordance with some embodiments may be used in a common area of the aircraft. For example, passengers in the target region of video display 980 may be able to hear the audio associated with the video display 980, but the passengers standing or seated at other locations 985 and 987 will not.

As discussed herein, some embodiments of the present inventive concept use directional sound technology to direct and beam form audio sound waves directly to a single individual passenger, multiple passengers or a target region without others outside the target region hearing the audio or being bothered by the audio. Thus, embodiments of the present inventive concept remove the need for uncomfortable headphones or earphones used by the passenger and, thus, reduce the workload on the flight attendants who no longer have to pass out the headphones/earphones. Furthermore, the headphones/earphones do not have to be cleaned and there is no longer a worry about abuse or theft of these devices.

As discussed above, in some embodiments directional sound systems use speakers including a plurality of audio transducers, a directional sound controller unit and related algorithms to beam form and shape the sound to directly to one single passenger eliminating sound leakage or reflections to other adjacent passengers. In some embodiments, the directional sound technology may also be applied and directed to a group of passenger divided by class, for example, premium versus business class versus coach class, which could be which could be used for public announcements.

In some embodiments of the present inventive concept, each individual passenger could be beamed audio meant only for that passenger even though the passenger is in a group watching the same video. Thus, each passenger can be targeted individually based on his/her preferred likes and/or customized preferences. Some embodiments of the present inventive concept may be directed at a single passenger or group of passengers to provide noise cancellation or noise reduction of the aircraft or passenger noise within the cabin environment.

It will be understood that directional sound systems in accordance with embodiments discussed herein are configured to be in compliance with Federal Aviation Administration (FAA), Airbus and Boeing environment and electrical certification including flammability, and Electromagnetic Interference (EMI).

In the above-description of various embodiments of the present inventive concept, it is to be understood that the terminology used herein is for the purpose of describing particular embodiments only and is not intended to be limiting of the inventive concept. Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of this specification and the relevant art and will not be interpreted in an idealized or overly formal sense expressly so defined herein.

When an element is referred to as being "connected", "coupled", "responsive", or variants thereof to another node, it can be directly connected, coupled, or responsive to the other element or intervening element may be present. In contrast, when an element is referred to as being "directly connected", "directly coupled", "directly responsive", or variants thereof to another element, there are no intervening element present. Like numbers refer to like element throughout. Furthermore, "coupled", "connected", "responsive", or variants thereof as used herein may include wirelessly coupled, connected, or responsive. As used herein, the singular forms "a", "an" and "the" are intended to include the plural forms as well, unless the context clearly indicates otherwise. Well-known functions or constructions may not be described in detail for brevity and/or clarity. The term "and/or" includes any and all combinations of one or more of the associated listed items.

As used herein, the terms "comprise", "comprising", "comprises", "include", "including", "includes", "have", "has", "having", or variants thereof are open-ended, and include one or more stated features, integers, elements, steps, components or functions but does not preclude the presence or addition of one or more other features, integers, elements, steps, components, functions or groups thereof. Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Example embodiments are described herein with reference to block diagrams and/or flowchart illustrations of computer-implemented methods, apparatus (systems and/or devices) and/or computer program products. It is understood that a block of the block diagrams and/or flowchart illustrations, and combinations of blocks in the block diagrams and/or flowchart illustrations, can be implemented by computer program instructions that are performed by one or more computer circuits. These computer program instructions may be provided to a processor of a general purpose computer circuit, special purpose computer circuit, and/or other programmable data processing circuit to produce a machine, such that the instructions, which execute via the processor of the computer and/or other programmable data processing apparatus, transform and control transistors, values stored in memory locations, and other hardware components within such circuitry to implement the functions/acts specified in the block diagrams and/or flowchart block or blocks, and thereby create means (functionality) and/or structure for implementing the functions/acts specified in the block diagrams and/or flowchart block(s).

These computer program instructions may also be stored in a tangible computer-readable medium that can direct a computer or other programmable data processing apparatus to function in a particular manner, such that the instructions stored in the computer-readable medium produce an article of manufacture including instructions which implement the functions/acts specified in the block diagrams and/or flowchart block or blocks.

A tangible, non-transitory computer-readable medium may include an electronic, magnetic, optical, electromagnetic, or semiconductor data storage system, apparatus, or device. More specific examples of the computer-readable medium would include the following: a portable computer diskette, a random access memory (RAM) circuit, a read-only memory (ROM) circuit, an erasable programmable read-only memory (EPROM or Flash memory) circuit, a portable compact disc read-only memory (CD-ROM), and a portable digital video disc read-only memory (DVD/BlueRay).

The computer program instructions may also be loaded onto a computer and/or other programmable data processing apparatus to cause a series of operational steps to be performed on the computer and/or other programmable apparatus to produce a computer-implemented process such that the instructions which execute on the computer or other programmable apparatus provide steps for implementing the functions/acts specified in the block diagrams and/or flowchart block or blocks. Accordingly, embodiments of the present inventive concept may be embodied in hardware and/or in software (including firmware, resident software, micro-code, etc.) that runs on a processor such as a digital signal processor, which may collectively be referred to as "circuitry," "a module" or variants thereof.

It should also be noted that in some alternate implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved. Moreover, the functionality of a given block of the flowcharts and/or block diagrams may be separated into multiple blocks and/or the functionality of two or more blocks of the flowcharts and/or block diagrams may be at least partially integrated. Finally, other blocks may be added/inserted between the blocks that are illustrated. Moreover, although some of the diagrams include arrows on communication paths to show a primary direction of communication, it is to be understood that communication may occur in the opposite direction to the depicted arrows.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of various example combinations and subcombinations of embodiments and of the manner and process of making and using them, and shall support claims to any such combination or subcombination.

Many variations and modifications can be made to the embodiments without substantially departing from the principles of the present inventive concept. All such variations and modifications are intended to be included herein within the scope of the present inventive concept.

That which is claimed is:

1. An entertainment system comprising:

directional sound speakers associated with a media player of the entertainment system; a directional sound controller associated with the directional sound speakers of the media player, the directional sound controller being configured to direct a sound beam associated with the media player at a defined target region such that the sound beam is only audible within the defined target region and experiences less than about 20 dB of leakage outside the target region during operation of the media player; a seat within the target region, wherein the media player and directional sound speakers are integrated in a back portion of the seat; and a hood configured to be positioned over the target region to create a cone of sound for the target region.

2. The entertainment system of claim 1, wherein the target region experiences no greater than about 5.0 dB of leakage during operation of the media player.

3. The entertainment system of claim 1, wherein the directional sound controller comprises a beam forming and audio wave shaping module configured to direct the sound beam such that the sound beam extends to a preset distance from the directional sound speakers.

4. The entertainment system of claim 3, wherein the preset distance is from about 2.5 to about 10 feet from the directional sound speakers.

5. The entertainment system of claim 4, wherein the sound beam extends no greater than about 2.5 feet from the directional sound speakers.

6. The entertainment system of claim 3, further comprising transducers and/or a sound dome, wherein the beam forming and audio wave shaping module is configured to direct the sound beam such that the sound beam extends to a preset distance from the directional sound speakers, the transducer and/or the sound dome.

7. The entertainment system of claim 3, wherein the beam forming and audio wave shaping module is further configured to direct the sound beam in a horizontal direction away from the directional sound speakers and toward the target region.

8. The entertainment system of claim 3, wherein the directional sound controller further comprises a noise cancelling/reduction module that is configured to reduce and/or neutralize sound leakage outside the target region.

9. The entertainment system of claim 1, wherein the hood comprises a Plexiglas hood.

10. The entertainment system of claim 1, wherein each of the directional sound speakers comprises a cluster of smaller speakers and/or transducers.

11. The entertainment system of claim 1, wherein the seat comprises sound absorbing materials.

12. The entertainment system of claim 1, wherein each of the directional sound speakers are configured to include a plurality of audio transducers.

13. The entertainment system of claim 12, wherein the plurality of audio transducers comprise from about 50 to about 200 audio transducers.

14. The entertainment system of claim 1, wherein the entertainment system comprises an in-flight entertainment (IFE) system on an aircraft.

15. The entertainment system of claim 14, wherein the IFE system is designed to comply with Federal Aviation Administration (FAA), Airbus and Boeing standards.

16. The entertainment system of claim 14, wherein the media player comprises a smart video display unit associated with the IFE system, the smart video display unit being integrated into a seatback on the aircraft.

17. The entertainment system of claim 16, wherein the target region is one of a seat on the aircraft, a group of seats on the aircraft and a specific location in a common area on the aircraft.

18. The entertainment system of claim 17, wherein the target region is a seat in first class, business class and/or coach class.

19. The entertainment system of claim 1, wherein the target region is a single user or group of users.

20. The entertainment system of claim 1, wherein the entertainment system is integrated with a vehicle.

21. The entertainment system of claim 20, wherein the vehicle comprises a train, a bus, a cruise ship and/or a military aircraft.

22. An in-flight entertainment (IFE) system for use on an aircraft, the IFE system comprising: a media player integrated into the aircraft; directional sound speakers associated with the media player of the IFE system; a directional sound controller associated with the directional sound speakers of the media player, the directional sound controller being configured to direct a sound beam associated with the media player at a defined target region of the aircraft such that the sound beam is only audible within the defined target region of the aircraft and experiences less than about 20 dB of leakage outside the target region during operation of the media player;

and a hood configured to be positioned over a passenger seated in a seat of the aircraft to create a cone of sound for the passenger.

23. The IFE system of claim 22: wherein the media player is integrated into a seat back in the aircraft; wherein the target region comprises the hood and the passenger seated in the seat of the aircraft; and wherein the directional sound controller is configured to direct a sound beam associated with the media player at the passenger seated in the seat of the aircraft such that the sound beam is only audible by the passenger seated in the seat.

24. The IFE system of claim 23, wherein the target region experiences no greater than about 5.0 dB of leakage during operation of the media player.

25. The IFE system of claim 23, wherein the directional sound controller comprises a beam forming and audio wave shaping module configured to direct the sound beam such that the sound beam extends to a preset distance from the directional sound speakers.

26. The IFE system of claim 25, wherein the preset distance is from about 2.5 to about 10 feet from the directional sound speakers.

27. The IFE system of claim 25, wherein the sound beam extends no greater than about 2.5 feet from the directional sound speakers.

28. The IFE system of claim 25, further comprising transducers and/or a sound dome, wherein the beam forming and audio wave shaping module is configured to direct the sound beam such that the sound beam extends to a preset distance from the directional sound speakers, the transducer and/or the sound dome.

29. The IFE system of claim 23, wherein the seat comprises sound absorbing materials.

30. The IFE system of claim 23, wherein the IFE system is designed to comply with Federal Aviation Administration (FAA), Airbus and Boeing standards.

31. A method of directing sound of a media player on an aircraft, the method comprising: directing a sound beam associated with a media player integrated in an in-flight entertainment (IFE) system of the aircraft at a defined target region of the aircraft such that a sound beam created by directional sound speakers associated with the media player of the IFE system is only audible within the defined target region of the aircraft and experiences less than about 20 dB of leakage outside the target region during operation of the media player, wherein the target region is defined by a hood positioned over a passenger seated in a seat of the aircraft to create a cone of sound for the passenger.

32. The method of claim 31, wherein the target region experiences no greater than about 5.0 dB of leakage during operation of the media player.

33. The method of claim 31, further comprising directing the sound beam such that the sound beam extends to a preset distance from about 2.5 to about 10.0 feet from the directional sound speakers.

34. The method of claim 31, further comprising directing the sound beam such that the sound beam extends no greater than about 2.5 feet from the directional sound speakers.

* * * * *